US008850939B2

(12) United States Patent
Patella

(10) Patent No.: US 8,850,939 B2
(45) Date of Patent: Oct. 7, 2014

(54) STRAIGHT EDGE GUIDE

(76) Inventor: Ronald Patella, Clearwater, FL (US)

( * ) Notice: Subject to any disclaimer, the term of this patent is extended or adjusted under 35 U.S.C. 154(b) by 526 days.

(21) Appl. No.: 12/911,761

(22) Filed: Oct. 26, 2010

(65) Prior Publication Data

US 2011/0107891 A1 May 12, 2011

Related U.S. Application Data

(60) Provisional application No. 61/279,689, filed on Oct. 26, 2009.

(51) Int. Cl.
*B26D 7/06* (2006.01)
*B27B 25/10* (2006.01)

(52) U.S. Cl.
CPC ..... *B27B 25/10* (2013.01)
USPC ..... 83/438; 83/446; 144/253.7; 108/143

(58) Field of Classification Search
USPC ..... 83/446, 444, 438, 474, 437.1, 442, 447; 144/286.5, 253.7; 108/143, 102
See application file for complete search history.

(56) References Cited

U.S. PATENT DOCUMENTS 2,722,247 A * 11/1955 Schroeder et al. ..... 83/446
3,269,435 A * 8/1966 Houston, Jr. ..... 83/439
5,116,249 A * 5/1992 Shiotani et al. ..... 83/435.14
5,201,863 A * 4/1993 Peot ..... 83/432
5,367,933 A * 11/1994 Jaksha ..... 83/440.2
5,823,084 A * 10/1998 Ramey ..... 83/415
5,954,106 A * 9/1999 Huang ..... 144/286.5
6,148,705 A * 11/2000 Shieh ..... 83/435.27
6,619,348 B2 * 9/2003 Wang ..... 144/287
7,017,464 B2 * 3/2006 Coderre ..... 83/446
7,140,286 B2 * 11/2006 Schwartz ..... 83/446
7,240,706 B2 * 7/2007 Liu et al. ..... 144/286.5
7,373,961 B2 * 5/2008 Liu et al. ..... 144/286.1
7,490,643 B2 * 2/2009 Liu et al. ..... 144/286.5
7,997,313 B2 * 8/2011 Wang ..... 144/286.1
2002/0162439 A1 * 11/2002 Fontaine ..... 83/438
2003/0140985 A1 * 7/2003 Wang ..... 144/287
2005/0005754 A1 * 1/2005 Coderre ..... 83/446
2005/0241450 A1 * 11/2005 Schwartz ..... 83/446
2006/0213579 A1 * 9/2006 Liu et al. ..... 144/287
2007/0113928 A1 * 5/2007 Liu et al. ..... 144/286.5
2007/0246124 A1 * 10/2007 Liu et al. ..... 144/287
2010/0107840 A1 * 5/2010 Rybka et al. ..... 83/446
2010/0199824 A1 * 8/2010 Remmert et al. ..... 83/444
2010/0307302 A1 * 12/2010 Smith ..... 83/13
2011/0056347 A1 * 3/2011 Economaki ..... 83/14

* cited by examiner

*Primary Examiner* — Omar Flores Sanchez
(74) *Attorney, Agent, or Firm* — Defillo & Associates, Inc; Evelyn A. Defillo

(57) ABSTRACT

The present invention relates to a straight edge device for use in conjunction with power tools such as radial saws, or table saws. The present invention is used for cutting an uneven edge of a board. The straight edge device includes a one piece board having a protuberance projecting from its lower surface that engages a groove of the table saw. The board is placed on the upper surface of the one piece board with the uneven edge hanging over the edges of the one piece board. As the straight edge device is pushed or pulled through the groove of the table saw, the cutting blade straights the uneven edge of the board.

3 Claims, 4 Drawing Sheets

STRAIGHT EDGE GUIDE

This application claims the benefit of Provisional Application No. 61/279,689 filed Oct. 26, 2009, the contents of which are incorporated herein by reference.

FIELD OF THE INVENTION

The invention relates to a new and useful edge guide device for table saws for cutting straight edges on planks of wood or plywood which do not have a straight edge to begin work with.

BACKGROUND OF THE INVENTION

Table saws are typically used to cut boards into a desired shape or dimension. However, sometimes the worker is faced with boards that have crooked edges. One of the edges has to be straightened before the other edge can be straightened in order to provide finished joinable board. After one of the edges of the board is straightened, it is easy to cut the other uneven edge by simply running the straightened edge along the fence of the table saw.

The prior art shows many devices that have been use for the purpose of straight-lining the edge of boards. Unfortunately, the known devices are either expensive motorized machines, difficult to use because they contain too many parts, inefficient, time consuming, cumbersome to use, and limited in the length of board they can handle. This becomes apparent when more than a few boards require straight-lining.

As can be seen, there is a need for a device for straightening crooked, uneven edged boards that is inexpensive to manufacture, has a minimum number of parts, and is easy to assemble and dissemble.

SUMMARY OF THE INVENTION

It is an object of the present invention to provide a straight edge device to be used with boards with two uneven edges that need to be straightened.

It is an object of the present invention to provide a straight edge device to be used with boards with two uneven edges that need to be straightened that has a minimum number of parts.

It is an object of the present invention to provide a straight edge device to be used with boards with two uneven edges that need to be straightened that is simple in construction.

It is an object of the present invention to provide a straight edge device to be used with boards with two uneven edges that need to be straightened that is light in weight.

In one aspect of the present invention, the straight edge device includes a one piece board having an upper surface, a lower surface, and a protuberance projecting from the lower surface of the one piece board.

In another aspect of the present invention, the straight edge device may be used in conjunction with a conventional table saw so as to cut a straight edge on a board having an uneven edge, the table saw includes a working surface, at least one table saw groove, a cutting blade extending above the work surface, the straight edge device includes a one piece board having an upper surface, a lower surface, and a protuberance extending from the lower surface of the one piece board; the upper surface of the one piece board is adapted to support the board and when the protuberance of the one piece board is pushed through the groove of the table saw, the device gives a straight edge to the uneven board.

These and other features, aspects, and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can be each used independently of one another or in combination with other features.

Figure 1:
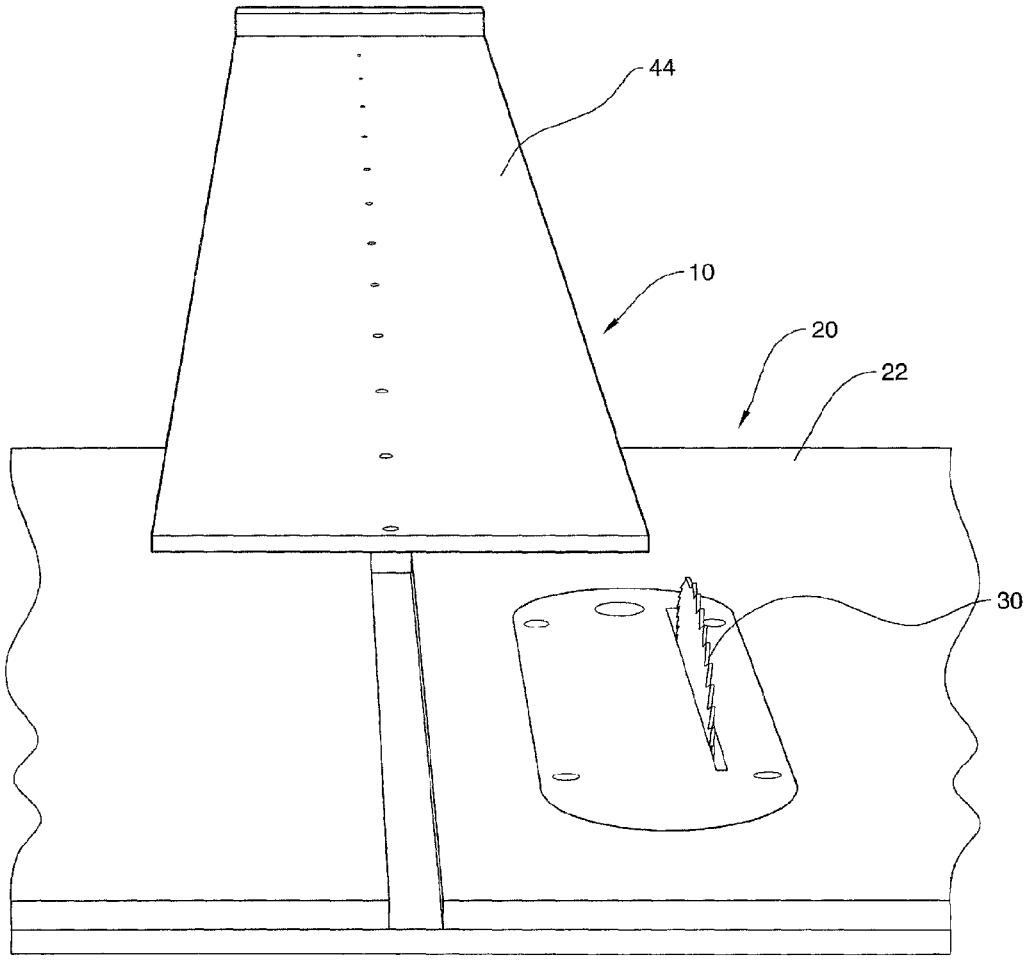
FIG. 1 illustrates a perspective front view of the straight edge device according to an exemplary embodiment of the present invention used in conjunction with a table saw.
Figure 2:
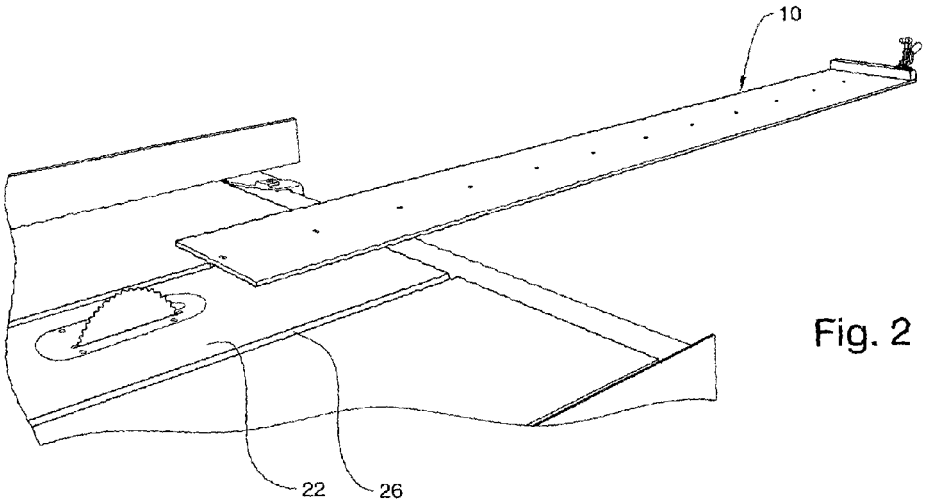
FIG. 2 illustrates a perspective side view of the straight edge device of FIG. 1.
Figure 3:
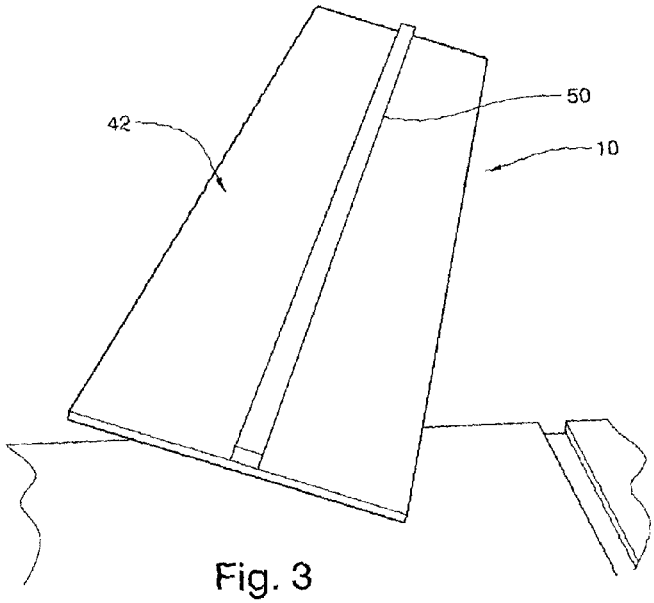
FIG. 3 illustrates a perspective bottom view of the straight edge device according to an exemplary embodiment of the present invention.
Figure 5:
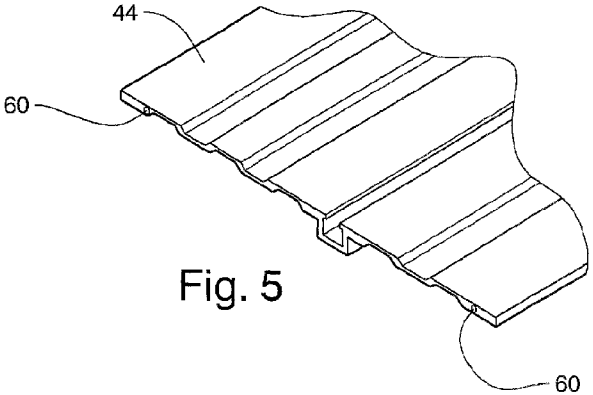
FIG. 5 illustrates a cross-sectional view of the straight edge device taken along the lines C-C of FIG. 4.
Figure 6:
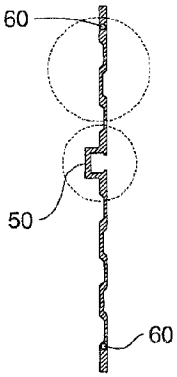
FIG. 6 illustrates a perspective side view of the straight edge device of FIG. 4.

FIGS. 1 and 2 show the straight edge device 10 according to the present invention being used in conjunction with a table saw 20. The table saw 20 may include a working surface 22, at least one table saw groove 26, and a circular blade 30. The table saw groove 26 may extend along the length of the working surface 22.

The straight edge device 10 according to the present invention may include a one piece board 40 having a protuberance 50 extending downward from the bottom surface 42 of the one piece board 40. The one piece board 40 may be made of plastic, metal, fiber, resin, composite material, fiberglass, glass, wood, or any other suitable material. In one embodiment, the one piece board 40 may be made of extruded plastic. In another embodiment, the one piece board 40 may be made of extruded aluminum. In another embodiment, the one piece board 40 may be made of the lightweight material. The one piece board 40 may have a length between 2 to 16 feet. The length of the one piece board 40 may depend on the customer necessity, manufacturing process, and/or shipping.

In one embodiment, the top side of the protuberance 50 may be a T-slot. The size of the protuberance 50 may depend on the size of the groove 26. The size of the protuberance 50 may be determined to fit properly into the groove 26. The protuberance 50 may have a width between 0.25 to 1.5 inches. In one embodiment, the width of the protuberance 50 may be 0.748 inches. The protuberance 50 may have a depth between 0.20 to 0.50 inches. In one embodiment, the depth of the protuberance 50 may be 0.370 inches In one embodiment, the one piece board 40 may include a handle (not shown) for the operator to easily carry the straight edge device 10 when not in use. In one embodiment, a T-bolt may be placed on the top side of the protuberance 50 to hold down the board 32.

The one piece board 40 may have a width between 5 to 12 inches. In one embodiment, the width of the one piece board 40 may be 9 inches. The one piece board 40 may have thickness, including the protuberance 50, between 0.125 to 0.75 of an inch.

In one embodiment the one piece board 40 may have flat surface. In another embodiment, the one piece board 40 may have an irregular shape. In one embodiment, the irregular shape may include peaks and valleys (FIGS. 4-8).

The protuberance 50 may be positioned in the lower surface 42 of the one piece board 40 at a distance slightly smaller than the distance between the table groove 26 and the circular blade 30. For safety reasons, it is desirable that the one piece board 40 does not come into contact with circular blade 30.

The ends of the one piece board 40 may include a coupling connection 60. This coupling connection 60 may be used for connecting to at least another one piece board (not shown) in order to extend the overall length or width of the straight edge device 10. In one embodiment, the coupling connection 60 may be a female and male connection. The coupling connection 60 may be an integral part of the one piece board 40. In one embodiment, the coupling connection 60 may be formed during the extrusion process. The number of one piece boards to be connected may be determined by the length or width of the board to be straightened.

One end of the straight edge device 10 may be positioned resting on a stand 70. The stand 70 may assist in keeping the straight edge device 10 on the same plane as table saw 20 which facilitates loading of board 32. In addition, the stand 70 may help during the usage of the straight edge device through the table saw 20.

Figure 9:
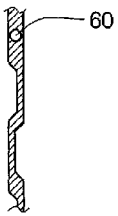
FIG. 9 illustrates a detailed view of section B of FIG. 5.
Figure 8:
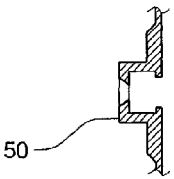
FIG. 8 illustrates a detailed view of section A of FIG. 5.
Figure 4:
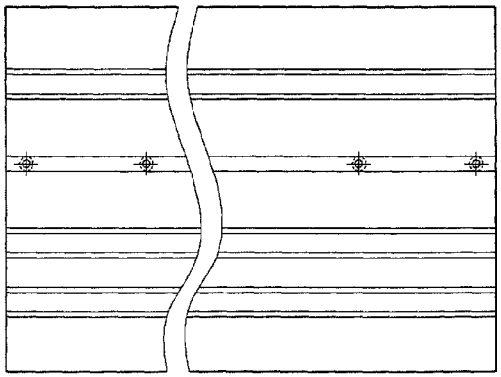
FIG. 4 illustrates a top view of the straight edge device according to another exemplary embodiment of the present invention.
Figure 7:
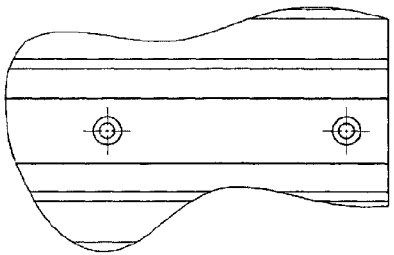
FIG. 7 illustrates a detailed view of Cross section C-C of FIG. 5.
Figure 10:
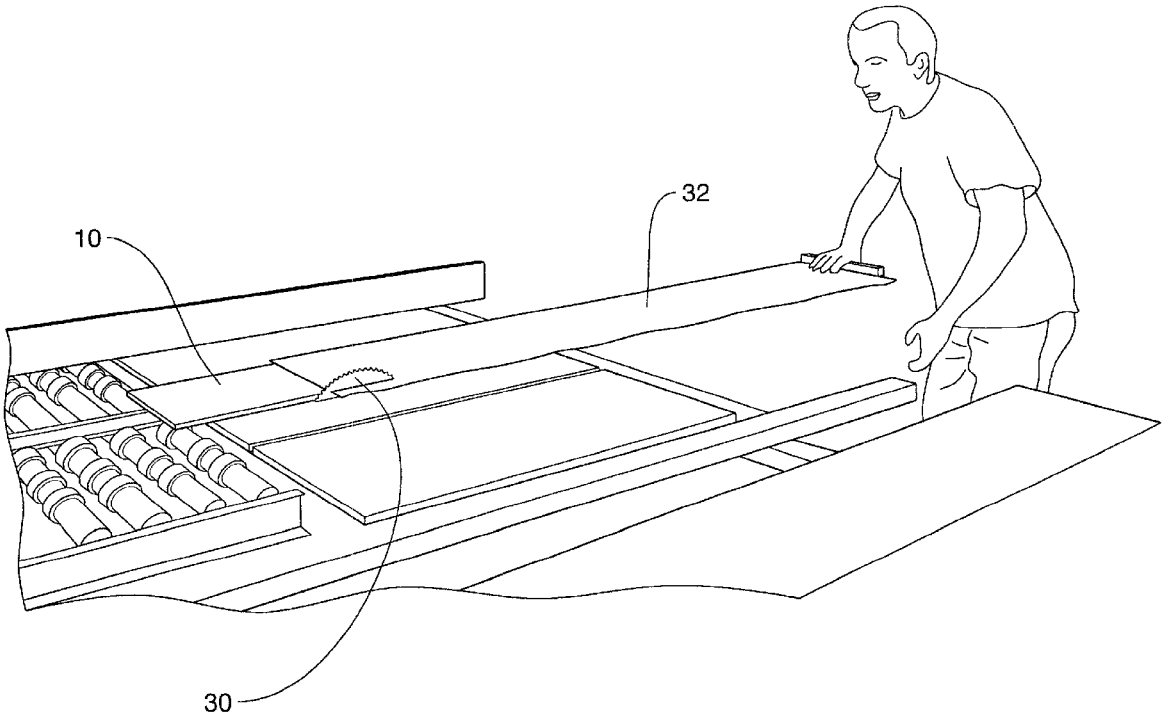
FIG. 10 illustrates a perspective front view of the straight edge device according to an exemplary embodiment of the present invention during operation.

The other end of the one piece board 40 may be positioned on top of the working surface 22 with protuberance 50 placed inside the groove 26 of the table saw 20. The board 32 may be positioned in contact with the upper surface 44 of the one piece board 40. One of the uneven edges of the board to be straightened may be placed hanging over the edges of the one piece board 40 and in contact with the cutting blade 30. The straight edge device 10 may be pushed or pulled across the table saw 20 guided by the protuberance 50 riding in the groove 26 and a straight cut may be made upon one of the un even edges of the board 32. (FIG. 9)

Once the board 32 has been pushed through the table saw 20 using the straight edge device 10, one of the uneven edges of the board 32 may be straightened with a single cut. This may be accomplished without extensive setup time and therefore increases the production volume. For similar uneven boards 32, an adjustment of the straight edge device 10 may not be necessary. However, if necessary the adjustment may be done easily to accommodate the individual board 32.

The straight edge device 10 according to the present invention may allow the uneven edges of the board to be easily cut into boards which have straight edges without guiding an irregular edge of the board along the fence 28 of the table saw 20.

It should now be apparent that the simple design of the straight edge device 10 according to the present invention may be able to straighten the edges of a board 32 which could have two curved or uneven edges. The straight edge device 10 may provide a cost effective, efficient and accurate way of straight-lining boards of varying uneven widths and thicknesses.

The straight edge device 10 was described above with reference to table saws. However, this reference is not intended to limit the scope of this invention in any manner. The present invention may be used with any type of groove and cutting power tool.

It should be understood, of course, that the foregoing relates to exemplary embodiments of the invention and that modifications may be made without departing from the spirit and scope of the invention as set forth in the following claims.

What I claim is:

1. A straight edge device consisting of:

a single lightweight extruded plastic or extruded aluminum board, the single piece board including:

an upper surface, a lower surface, a first end, a second end, an integrated handle, the handle projecting upward from an end of the upper surface, an integrated coupling connection formed on the second end of the single piece board, and an integrated U-shaped protuberance projecting from the lower surface of the single board, the U-shaped protuberance forms a hollow channel having side walls connected to the lower surface of the single piece board and a bottom side connecting the side walls.

2. A straight edge device adapted to be used with a conventional table saw to cut a straight edge on a board having two uneven edges, the conventional table saw having at least one working surface, at least one groove, at least one cutting blade extending above the working surface, the straight edge device consisting of:

a single lightweight extruded plastic or extruded aluminum board, the single piece board including:

an upper surface, a lower surface, a first end, a second end, an integrated handle, the handle projecting upward from an end of the upper surface, an integrated coupling connection formed on the second end of the single piece board, and an integrated U-shaped protuberance projecting from the lower surface of the single board, the U-shaped protuberance forms a hollow channel having side walls connected to the lower surface of the single piece board and a bottom side connecting the side walls;

the single board includes a plurality of peaks and valleys through the upper surface and the lower surface;

wherein the upper surface of the single board is adapted to be in direct contact with the board; and wherein the protuberance of the single board is pushed through the groove of the table saw, the cutting blade straightens the uneven edges of the board.

3. A straight edge device comprising:

a single lightweight extruded plastic or extruded aluminum board having:

an upper surface, a lower surface, a first end, a second end, an integrated U-shaped protuberance projecting from the lower surface of the single board, the U-shaped protuberance forms a hollow channel having side walls connected to the lower surface of the single piece board and a bottom side connecting the side walls;

an integrated coupling connection formed on the second end of the single piece board, and an integrated handle, the handle projecting upward from an end of the upper surface the single piece board includes a plurality of peaks and valleys through the upper surface and the lower surface.

* * * * *